US005197609A

United States Patent [19]

Siegel

[11] Patent Number: 5,197,609

[45] Date of Patent: Mar. 30, 1993

[54] MERCHANDISE RACK FOR SUPPORTING PRODUCT DISPLAY CARDS BENEATH HORIZONTAL STORE SHELF SUPPORTS

[76] Inventor: Gerald Siegel, 12261 N. 74th St., Scottsdale, Ariz. 85260

[21] Appl. No.: 921,299

[22] Filed: Jul. 28, 1992

[51] Int. Cl.[5] ..... A47F 5/00

[52] U.S. Cl. ..... 211/57.1; 211/59.1; 211/119; 211/175

[58] Field of Search ..... 211/57.1, 59.1, 119, 211/113, 115, 175

[56] References Cited

U.S. PATENT DOCUMENTS

| | | | |
|---|---|---|---|
| 951,231 | 3/1910 | Bratton | 211/106 |
| 1,126,837 | 2/1915 | Nicholas | 211/59.1 |
| 3,139,985 | 7/1964 | Sinclair | 211/59.1 |
| 3,252,583 | 5/1966 | Walther et al. | 211/181 |
| 3,638,801 | 2/1972 | Larson | 211/57 |
| 3,830,375 | 8/1974 | Larson | 211/59 |
| 4,463,510 | 8/1984 | Windish | 211/59.1 |
| 4,705,175 | 11/1987 | Howard et al. | 211/59.2 |
| 4,712,692 | 12/1987 | Peinsipp | 211/181 |
| 5,038,944 | 8/1991 | Sorensen et al. | 211/59.1 |
| 5,038,946 | 8/1991 | Teuser et al. | 211/59.1 X |
| 5,060,809 | 10/1991 | Bayes et al. | 211/59.1 |

*Primary Examiner*—Robert W. Gibson, Jr.
*Attorney, Agent, or Firm*—Cahill, Sutton & Thomas

[57] ABSTRACT

A rack for supporting a plurality of product-carrying cards in wasted space beneath a shelf including first and second horizontal spaced beams includes a horizontal first cross member having a first end portion resting on a recessed shoulder of the first beam and a second end portion resting on a recessed shoulder of the second beam. A horizontal second cross member generally parallel to and spaced from the second cross member has a first end portion resting on the shoulder of the first beam and a second end portion resting on the shoulder of the second beam. A plurality of card support prongs extend through holes in the product-carrying cards. The first and second cross members carry a prong support assembly to which the prongs are attached below the level of lower surfaces of the first and second beams.

7 Claims, 2 Drawing Sheets

MERCHANDISE RACK FOR SUPPORTING PRODUCT DISPLAY CARDS BENEATH HORIZONTAL STORE SHELF SUPPORTS

BACKGROUND OF THE INVENTION

The present invention relates to a store fixture system designed to display and/or store card-mounted goods in space beneath shelves or racks that otherwise would be wasted.

In some stores, especially in "warehousing" types of retail stores, a great deal of the merchandise stock is stored on racks having horizontal shelf support beams such as 12A and 12B in FIG. 1. Each of the beams 12A and 12B have recessed shoulders such as 13A and 13B, respectively. Pallets or the like, indicated by dotted line 14, carrying large items of merchandise or large boxes of merchandise often are stored on the upper surfaces of shelf support beams, such as 12A and 12B. Additional shelf support beams (not shown) are arranged above and below the ones shown in FIG. 1. Thus, a pair of similar shelf support beams carrys merchandise, the top portion of which is generally indicated by numeral 19. below beams 12A and 12B. The space 29 between the bottom of beams 12A and 12B and the top of merchandise 19 supported by the lower tier of shelf beams such as 12A and 12B is usually wasted. The wasted space 29 offers is a foot or two in height. Of course, wasted space in a commercial building often represents loss of a profit opportunity, especially if an inexpensive way can be found of effectively using the wasted space.

SUMMARY OF THE INVENTION

Accordingly, it is an object of the invention to provide a rack system for displaying card-mounted merchandise beneath preexisting shelves or the like to make effective use of space that otherwise would be wasted.

Briefly described, and in accordance with one embodiment thereof, the invention provides a rack for supporting a plurality of product-carrying cards, each having a hole therein, beneath a shelf or frame including first and second spaced horizontal shelf support beams, each shelf support beam including a generally horizontal shoulder. A horizontal first cross member has a first end portion resting on the shoulder of the first beam and a second end portion resting on the shoulder of the second beam. A horizontal second cross member generally parallel to and spaced from the first cross member has a first end portion resting on the shoulder of the first beam and a second end portion resting on the shoulder of the second beam. A plurality of support prongs extend through the holes in the product-carrying cards. The first and second cross members carry an assembly which supports the prongs below the level of lower surfaces of the first and second shelf support beams.

DETAILED DESCRIPTION OF THE PREFERRED EMBODIMENTS

Figure 1:
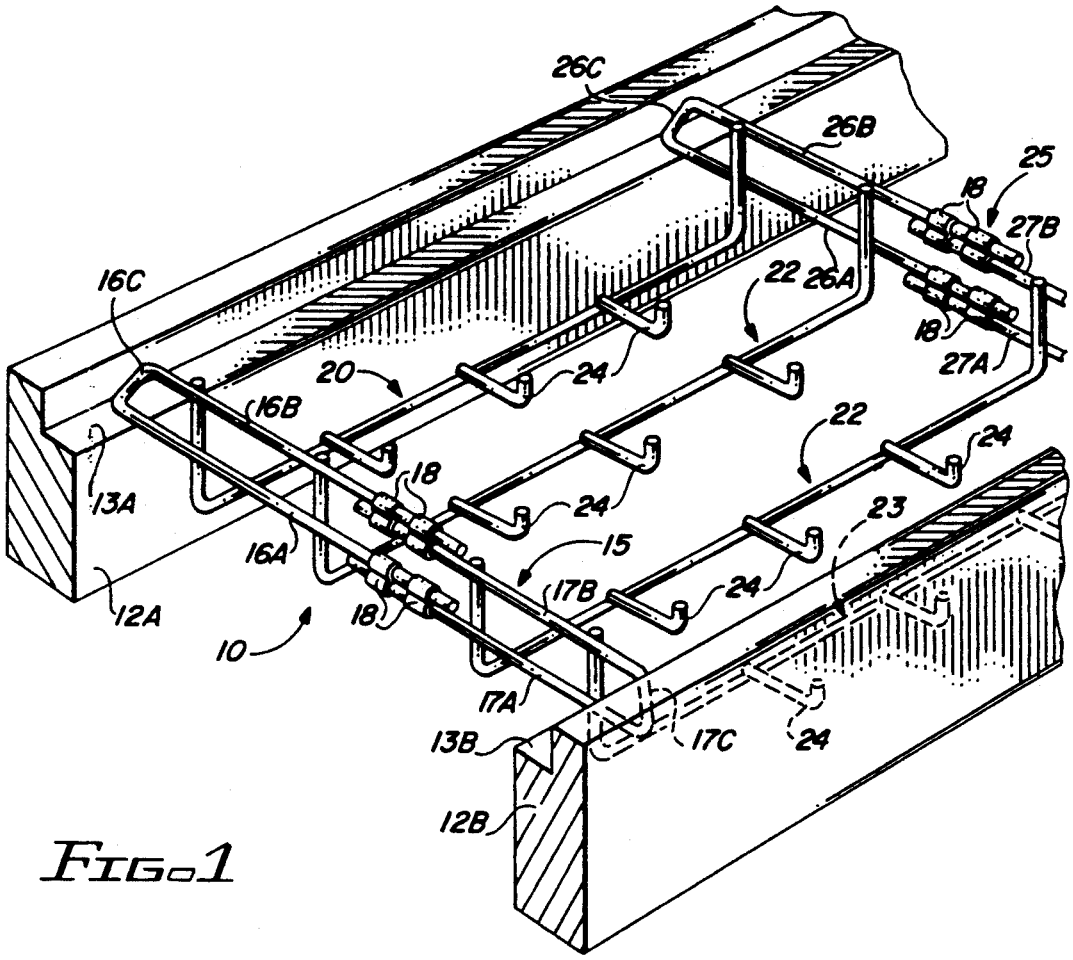
FIG. 1 is a partial perspective view illustrating the rack of the present invention supported by a pair of suitable shelf beams.
Figure 2:
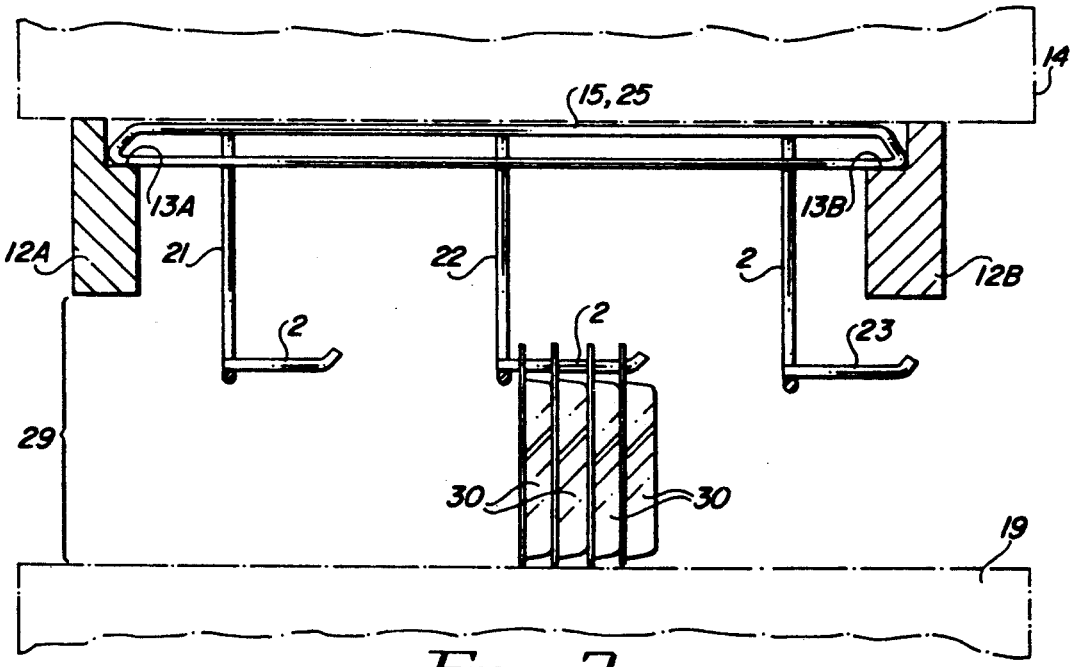
FIG. 2 is a side view of the rack system shown in FIG. 1.

Referring to FIGS. 1 and 2, product card rack 10 is supported on recessed shoulders 13A and 13B of shelf beams 12A and 12B, respectively. The upper surfaces of shelf beams 12A and 12B may support a pallet on which merchandise is stacked or supported. Such pallet and/or merchandise is indicated by numeral 14.

Product card rack 10 includes two horizontal, parallel, cross members 15 and 25, opposite ends of which rest on shoulders 13A and 13B. Cross member 15 includes a left elongated U-shaped section including horizontal, parallel legs 16A and 16B and a generally vertical connecting end section 16C. Cross member 15 also includes a right elongated U-shaped section including a lower horizontal leg 17A and an upper horizontal leg 17B connected thereto by a generally vertical end section 17C. The right and left end sections can be composed of stiff, shaped wire or other rigid rod material. The right and left sections are connected together by four clips 18 which allow the horizontal extent or length of cross member 15 to be adjusted to match the spacing between shoulders 13A and 13B.

Similarly, cross member 25 includes a left section 20 including horizontal legs 26A and 26B connected by a generally vertical end section 26C. The right portion of cross member 25 includes horizontal legs 27A and 27B connected by a generally vertical end section 27C. These sections are connected by four clips 18 which allow adjustment of the length of cross member 25.

Three or four prong support members such as 21, 22, and 23 each support a suitable number of card support prongs 24. Each prong 24 has a generally horizontal section and an upwardly inclined tip to prevent product cards such as 30 (FIG. 2) from sliding off. Each prong support member 21, 22, and 23 is generally U-shaped, with a horizontal center section having ends of various card support prongs 24 welded thereto. Each prong support 21, 22, etc. includes left and right vertical leg portions welded to the upper and lower legs of each of the left and right sections of cross members 15 and 25, respectively. The length of the vertical legs of the prong supporting members 21, 22, and 23 is selected so that the card support prongs 24 are supported slightly below the bottom surfaces of the shelf support beams 12A, 12B so that product-carrying cards such as 30 can be easily loaded onto or removed from the prongs 24, and can be easily seen in space 29 from the region in front of the shelving system.

Figure 3:
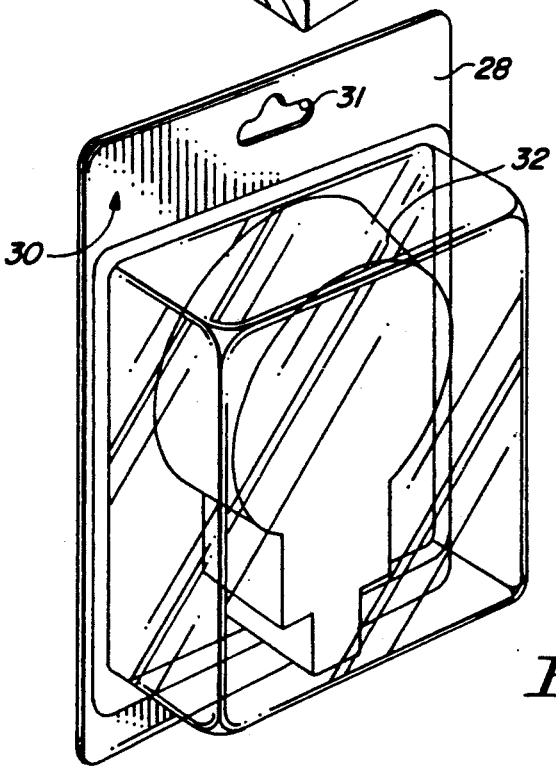
FIG. 3 is a perspective view of an item of card-mounted merchandise displayed by the rack of FIGS. 1 and 2.

FIG. 3 shows a typical product-carrying card 30 including a flat plastic or cardboard card 28 with a prong-receiving hole 31. A generalized product 32 is supported on the card 30 by various means, for example by plastic encapsulation, stapling, etc.

The above described embodiment of the invention provides a very inexpensive technique for using the otherwise wasted space 29 between the bottom of a particular shelf of a tiered shelving system and the top of merchandise supported by the next lower shelf.

Figure 4:
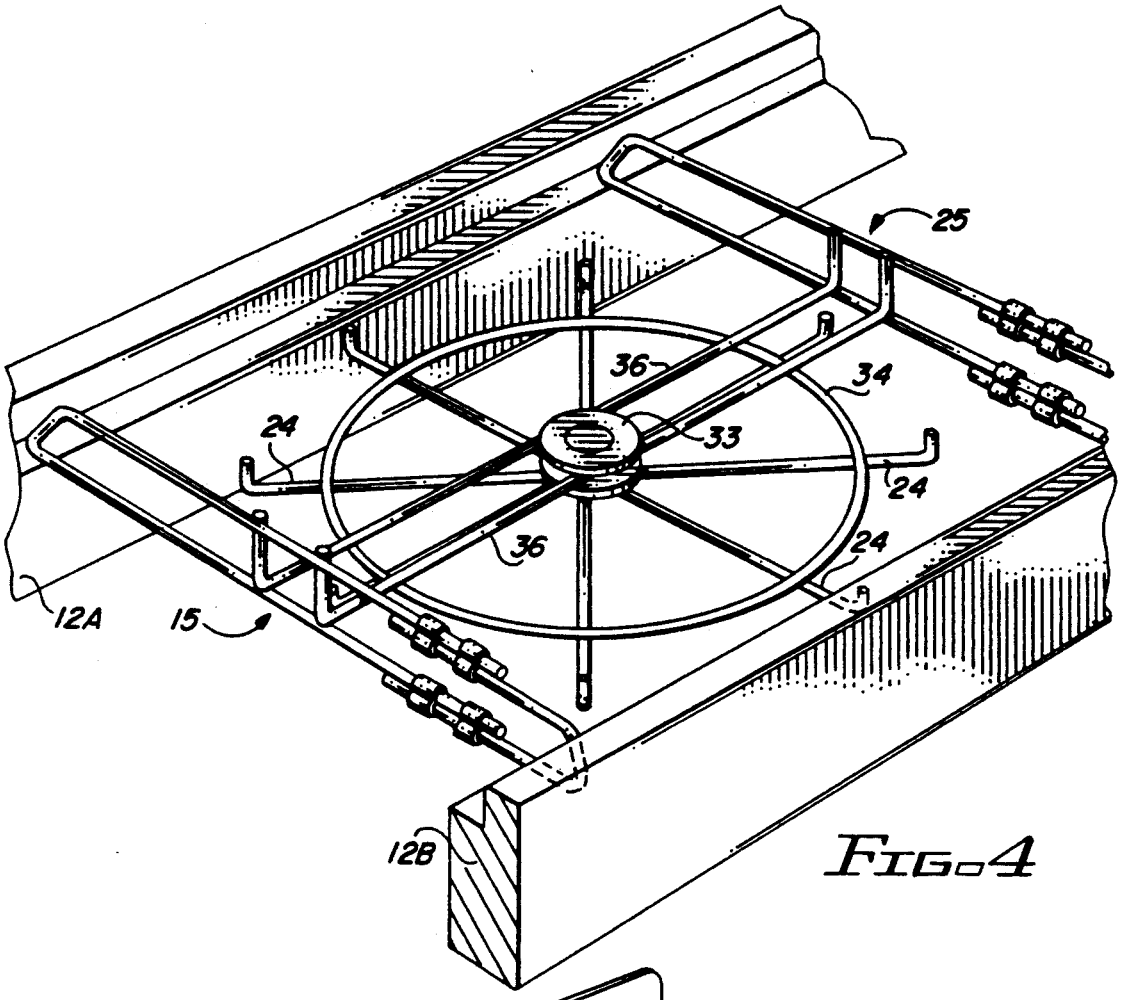
FIG. 4 is a perspective view of an alternate embodiment of the rack shown in FIG. 1.

FIG. 4 shows an alternate embodiment of the rack of FIG. 1 in which the prongs 24 are supported by a rotatable ring 34. Ring 34 is supported by a bearing 33, which is supported pair of cross members 36 parallel to beams 12A and 12B. Cross members 36 are supported by cross members 15 and 25 that rest on shoulders 13A and 13B.

While the invention has been described with reference to several particular embodiments thereof, those skilled in the art will be able to make the various modifications to the described embodiments of the invention without departing from the true spirit and scope of the invention. It is intended that all combinations of elements and steps which perform substantially the same function in substantially the same way to achieve the same result are within the scope of the invention. For example, instead of U-shaped rod structures as shown in FIGS. 1 and 4, the cross members can be telescoping tubular members.

What is claimed is:

1. A rack for supporting a plurality of product cards, each having a hole therein, beneath a shelf or frame including first and second spaced horizontal beams, each beam including a recessed shoulder, the rack comprising in combination:

(a) a horizontal first cross member having a first end portion resting on the shoulder of the first beam and a second end portion resting on the shoulder of the second beam;

(b) a horizontal second cross member generally parallel to and spaced from the second cross member and having a first end portion resting on the shoulder of the first beam and a second end portion resting on the recess surface of the second beam;

(c) a plurality of prongs extending through the holes in the product cards to support them; and (d) means connected to the first and second cross members for supporting the prongs lower than lower surfaces of the first and second beams.

2. The rack of claim 1 wherein the prong supporting means includes a plurality of spaced, parallel prong support members each having a first end portion attached to the first cross member, a second end portion attached to the second cross member, and a lower portion extending between the first and second end portions having a plurality of the prongs attached thereto.

3. The rack of claim 2 wherein all of the prongs are oriented in the same direction.

4. The rack of claim 2 wherein each of the first and second cross members includes opposed, aligned first and second elongated U-shaped sections composed of shaped rod material, free ends of corresponding legs of the first and second elongated U-shaped sections of each of the first and second cross members being connected together by slidable clips, whereby the lengths of the first and second cross members can be adjusted by axially sliding the free ends in the various clips.

5. The rack of claim 4 wherein each of the prong support members includes a U-shaped cross member having first and second vertical legs constituting the first and second end portion, respectively, and a bottom member constituting the lower portion and connecting the first and second vertical legs and having a plurality of the prongs attached thereto, the U-shaped cross members being composed of shaped rod material.

6. The rack of claim 1 wherein the prong supporting means includes a plurality of spaced, radially oriented prongs and rotatable means supported by the first and second cross members for supporting the spaced, radially oriented prongs.

7. A method of supporting a plurality of product cards, each having a hole therein, beneath a shelf or frame including first and second spaced horizontal beams, each beam including a shoulder, the method comprising the steps of:

(a) supporting first and second end portions of a horizontal first cross member on the shoulder of the first beam and the shoulder of the second beam, respectively;

(b) supporting first and second end portions of a horizontal second cross member positioned generally parallel to and spaced from the second cross member on the shoulder of the first beam and the shoulder of the second beam, respectively; and (c) supporting a plurality of product card support prongs by means of a prong carrying member, and supporting the prong carrying member by means of the first and second cross members so that the prongs are located lower the level of lower surfaces of the first and second beams, the prongs extending through holes in the product cards

* * * * *